US011517064B2

(12) United States Patent
Chen

(10) Patent No.: US 11,517,064 B2
(45) Date of Patent: Dec. 6, 2022

(54) SAFETY HELMET INNER LINING ADJUSTABLE FOR SUITABLE WEARING

(71) Applicant: Cheng-Ting Chen, Taipei (TW)

(72) Inventor: Cheng-Ting Chen, Taipei (TW)

( * ) Notice: Subject to any disclaimer, the term of this patent is extended or adjusted under 35 U.S.C. 154(b) by 133 days.

(21) Appl. No.: 17/039,882

(22) Filed: Sep. 30, 2020

(65) Prior Publication Data

US 2022/0071333 A1 Mar. 10, 2022

(30) Foreign Application Priority Data

Sep. 9, 2020 (TW) ..... 109130976

(51) Int. Cl.
*A42B 3/12* (2006.01)
*A42B 3/14* (2006.01)

(52) U.S. Cl.
CPC ..... *A42B 3/127* (2013.01); *A42B 3/145* (2013.01)

(58) Field of Classification Search
CPC ..... A42B 3/127; A42B 3/145; A42B 3/10
See application file for complete search history.

(56) References Cited

U.S. PATENT DOCUMENTS

| | | | | |
|---|---|---|---|---|
| 4,354,284 | A * | 10/1982 | Gooding | A42B 3/121 2/413 |
| 6,493,881 | B1 * | 12/2002 | Picotte | A42B 3/121 2/413 |
| 9,572,390 | B1 * | 2/2017 | Simpson | A42B 3/128 |
| 2013/0180034 | A1 * | 7/2013 | Preisler | A42B 3/127 2/455 |
| 2014/0020158 | A1 * | 1/2014 | Parsons | A42B 3/127 2/413 |
| 2015/0040296 | A1 * | 2/2015 | Hanson | A42B 3/069 2/411 |
| 2018/0199653 | A1 * | 7/2018 | Paige, Sr. | A42B 3/10 |

* cited by examiner

*Primary Examiner* — Tajash D Patel
(74) *Attorney, Agent, or Firm* — Muncy, Geissler, Olds & Lowe, P.C.

(57) ABSTRACT

The present invention provides a safety helmet inner lining adjustable for suitable wearing, consisting of: a covering body, which has an inner side surface that contacts a user's head and an outer side surface relative to the inner side surface; at least one interlayer pocket, which is disposed on the outer side surface of the covering body; and at least one cushiony pad, which is suitable for placement inside the interlayer pocket. A user is able to place the cushiony pads of suitable thickness into the interlayer pockets at preset positions according to the user's to head shape and dimensions. The inner lining is then put onto the head and a safety helmet put on top. The cushiony pads enable correcting the interspace between the user's head and the safety helmet, thereby allowing suitable and perfect fitting of the safety helmet that ensures safety of the wearer.

10 Claims, 9 Drawing Sheets

SAFETY HELMET INNER LINING ADJUSTABLE FOR SUITABLE WEARING

BACKGROUND OF THE INVENTION

(a) Field of the Invention

The present invention relates to a safety helmet inner lining, and more particularly to a safety helmet inner lining that is adjustable to fit a user's head shape and dimensions for wearing with a safety helmet.

(b) Description of the Prior Art

A safety helmet is an essential safety equipment that a person must wear when riding a motorcycle or when taking part in professional motor racing. In addition, a safety helmet worn when in a construction site is also a safety requirement to protect the wearer's head.

Heat and humidity causes the head to sweat and copiously secrete grease when wearing a safety helmet, the lining inside the safety helmet subsequently absorbs the grease and sweat resulting in an unpleasant smell, and is a breeding ground for hygienic and infectious diseases. Hence, the wearer who attaches importance to personal hygiene generally uses an inner lining to separate their head from the safety helmet, which enables convenient replacement and cleaning of the inner lining after absorbing sweat and grease.

The above-described inner lining is usually matched to the specifications and shape of the safety helmet, and can be divided into types including a full face covering, half open face covering, and an open face covering inner lining. Both the head and the neck portion of a user are covered when a full face inner lining is put onto the head, only leaving a sight opening for the eyes to see through, and thus classed as a personal accessory suitable for professional motor racing. A half open face inner lining is able to cover the crown portion and the hindbrain portion of the wearer's head, and thus suitable for wearing by motorcycle riders. The open face inner lining only covers the crown portion of the head, and thus suitable for wearing by motorcycle riders and construction site workers. Apart from the full face inner lining, both the half open face inner lining and the open face inner lining can be directly fixed to the inner side surface of the safety helmet to facilitate use thereof.

Although there are commercially available safety helmets with a plurality of dimensions for the consumer to choose from, however, specifications are limited and cannot completely match the variety of head shapes and head dimensions of different users.

After putting on a safety helmet, interspaces of different size occurring between the safety helmet inner side and the user's head result in an imperfect fit, which causes the safety helmet to wobble when the user moves their head. Thus, should an accident occur that subjects the safety helmet to an external force, then an additional applied force acts on the head portion. Hence, it is critical to provide a structure, components, or a device that a user can use to correct the above-described deficiencies and achieve a perfectly fitting safety helmet that is suitable for the majority of people.

SUMMARY OF THE INVENTION

The object of the present invention lies in providing a safety helmet inner lining adjustable for suitable wearing, the main characteristics of which are a plurality of interlayer pockets disposed at preset positions on the safety helmet inner lining. The interlayer pockets enable disposing cushiony pads of suitable thickness therein according to the interspace sizes between a user's head and the inner side surface of a safety helmet. Thus, after putting on a safety helmet on top of the inner lining, the interspaces formed between the user's head and the safety helmet are corrected by the inner lining and the cushiony pads to achieve a perfectly configured fitting, thereby improving comfortability and safety when wearing a safety helmet.

The disclosed technological means of the safety helmet inner lining adjustable for suitable wearing provided by the present invention comprise: a covering body, which is provided with an inner side surface that contacts a user's head, and an outer side surface relative to the inner side surface; at least one interlayer pocket, which is disposed on the outer side surface of the covering body; and at least one cushiony pad, which is suitable for placement inside the interlayer pocket. The covering body is used for placement over the user's head. The cushiony pads can be provided with a variety of thickness specifications, thus enabling the user to choose the cushiony pads of suitable thickness to dispose inside the interlayer pockets according to actual requirements. The cushiony pads are cushioned between the user's head and a safety helmet to achieve the object of comfortable wearing thereof.

It is preferable that the covering body of the present invention is formed with a crown portion, and the interlayer pockets are disposed on the crown portion. Accordingly, the cushiony pads disposed inside the interlayer pockets of the crown portion are used to provide support between the top side of the user's head and the safety helmet.

It is preferable that the covering body of the present invention is further formed with a hindbrain portion that is connected to the crown portion, wherein the hindbrain portion is disposed with other interlayer pockets. Accordingly, the cushiony pads disposed inside the interlayer pockets of the hindbrain portion are used to provide support between the rear of the user's head and the safety helmet.

It is preferable that the interlayer pockets of the present invention are rectangular shaped. Thus, using the cushiony pads of minimum size are able to provide an absolute maximum support effect.

It is preferable that each of the interlayer pockets of the present invention are provided with a rectangular shaped upper layer material and a rectangular shaped lower layer material. The two long sides and one short side of the lower layer material are fixed to the external surface, thereby enabling the other short side of the lower layer material to form a lower opening; and the two long sides and one short side of the upper layer material are fixed to the external surface, thereby enabling the other short side of the upper layer material to form an upper opening. A portion at one end of the upper opening of the upper layer material correspondingly overlaps a portion at one end of the lower opening of the lower layer material, thus positioning the upper opening on the upper side of the lower layer material and positioning the lower opening on the lower side of the upper layer material. Accordingly, each of the cushiony pads is disposed inside the interlayer pocket through the upper opening of the upper layer material formed by the upper layer material and the lower layer material. Moreover, overlapping of the upper opening and the lower opening prevents the cushiony pad from separating from the interlayer pocket.

It is preferable that the length direction of the interlayer pockets disposed on the crown portion of the covering body of the present invention extend from the front to the rear of the crown portion. Accordingly, an optimum support effect is achieved between the upper side of the head and a safety helmet.

It is preferable that the length direction of the interlayer pockets disposed on the hindbrain portion of the covering body of the present invention extend from the left to the right side of the hindbrain portion. Accordingly, an optimum support effect is achieved between the rear of the head and a safety helmet.

It is preferable that the cushiony pads of the present invention are made from pieces of foam material.

It is preferable that the foam material used to produce the cushiony pads of the present invention is sponge or foam.

Compared to the prior art, the safety helmet inner lining provided by the present invention enables matching the cushiony pads of suitable thickness to adjust suitability for a perfect fit according to a user's head shape and dimensions when wearing the safety helmet. Furthermore, the inner lining and the cushiony pads are used to separate the user's head and the safety helmet to achieve a perfectly configured fitting, thereby improving comfortability and safety when wearing a safety helmet.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

The following together with the drawings and the component numbers provides a more detailed description of the embodiments of the present invention, and after making a thorough study of the specification of the present invention, persons skilled in the art will accordingly be able to put into effect the described embodiments.

Embodiment 1

Figure 1:
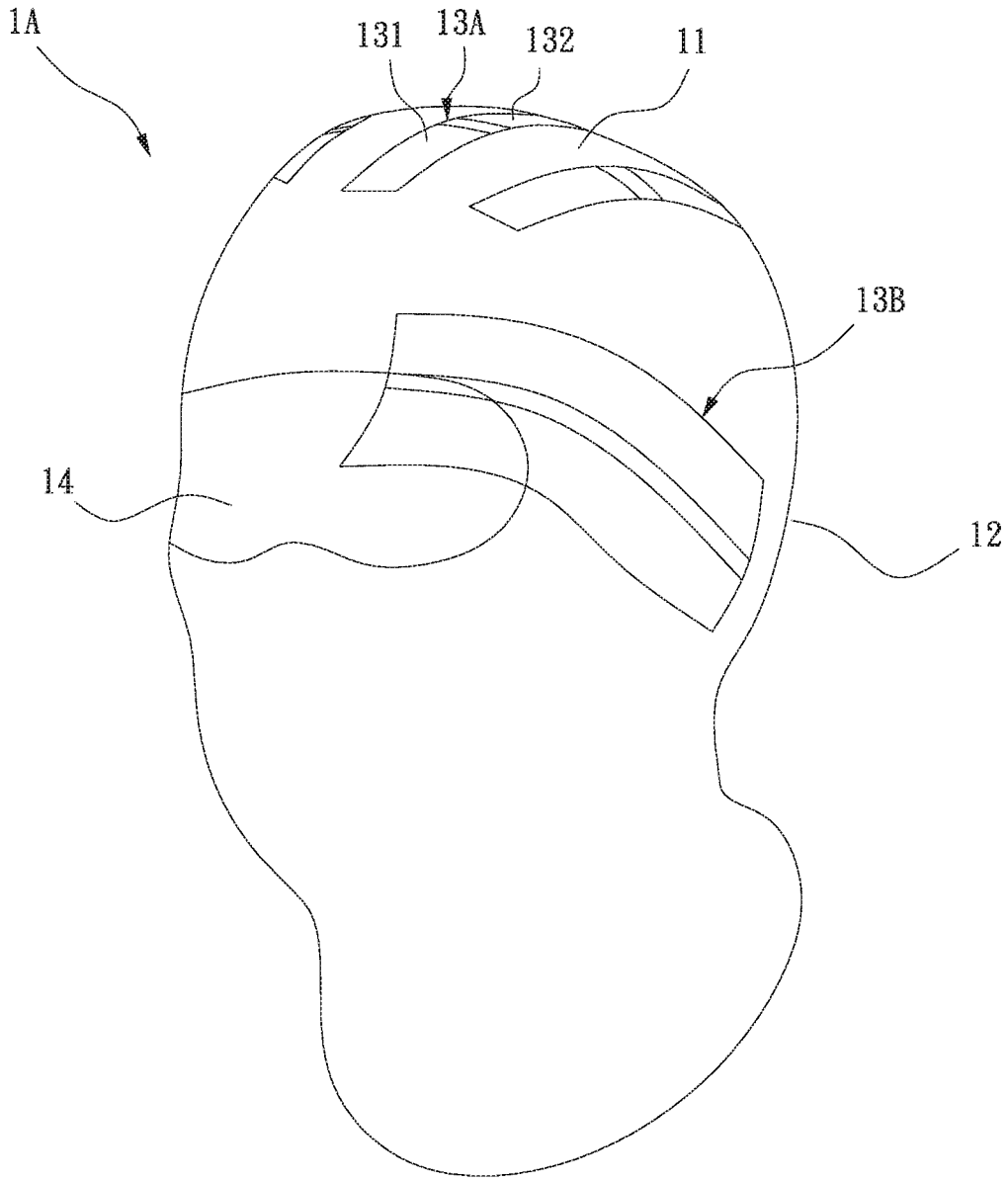
FIG. 1 is a three-dimensional schematic view of an embodiment of a full face inner lining structure of the present invention.
Figure 7:
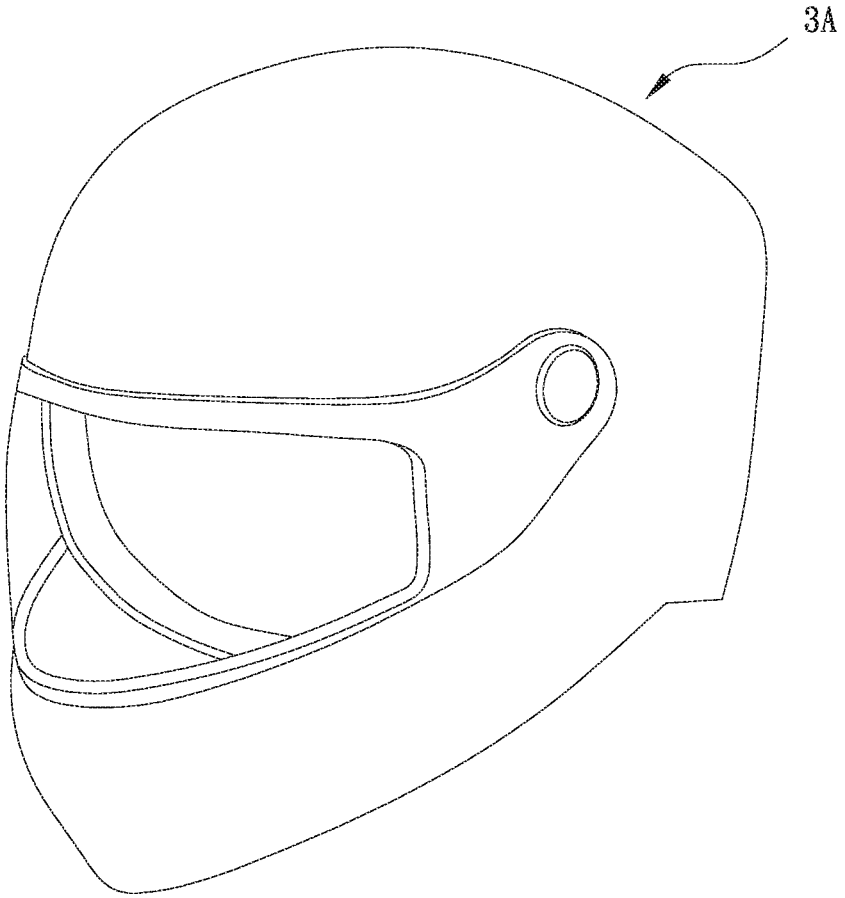
FIG. 7 is a schematic view of a general full face safety helmet.

FIG. 1 is a three-dimensional schematic view of a structure of an embodiment of a full face inner lining 1A of the present invention, wherein the full face inner lining 1A is provided with a covering body having the shape of a person's entire head, which enables covering both the head and neck portion of the user when worn, only leaving a sight opening 14 for the eyes to see through, and thus suitable for professional motor racing drivers to fittingly wear, as shown in FIG. 7. The covering body is provided with an inner side surface that is used to contact a user's head, and an outer side surface relative to the inner side surface. An upper portion of the outer side surface forms a crown portion 11 that corresponds to the upper extreme of a person's head, and a rear portion of the outer side surface forms a hindbrain portion 12 that is connected to the crown portion 11 and corresponds to the hindbrain of a person's head. In the present invention, at least one interlayer pocket 13A and at least one interlayer pocket 13B are disposed on the crown portion 11 and the hindbrain portion 12, respectively, according to actual requirements. For example, the embodiment shown in FIG. 1 shows three of the interlayer pockets 13A disposed on the crown portion 11 and one of the interlayer pockets 13B disposed on the hindbrain portion 12.

Figure 4:
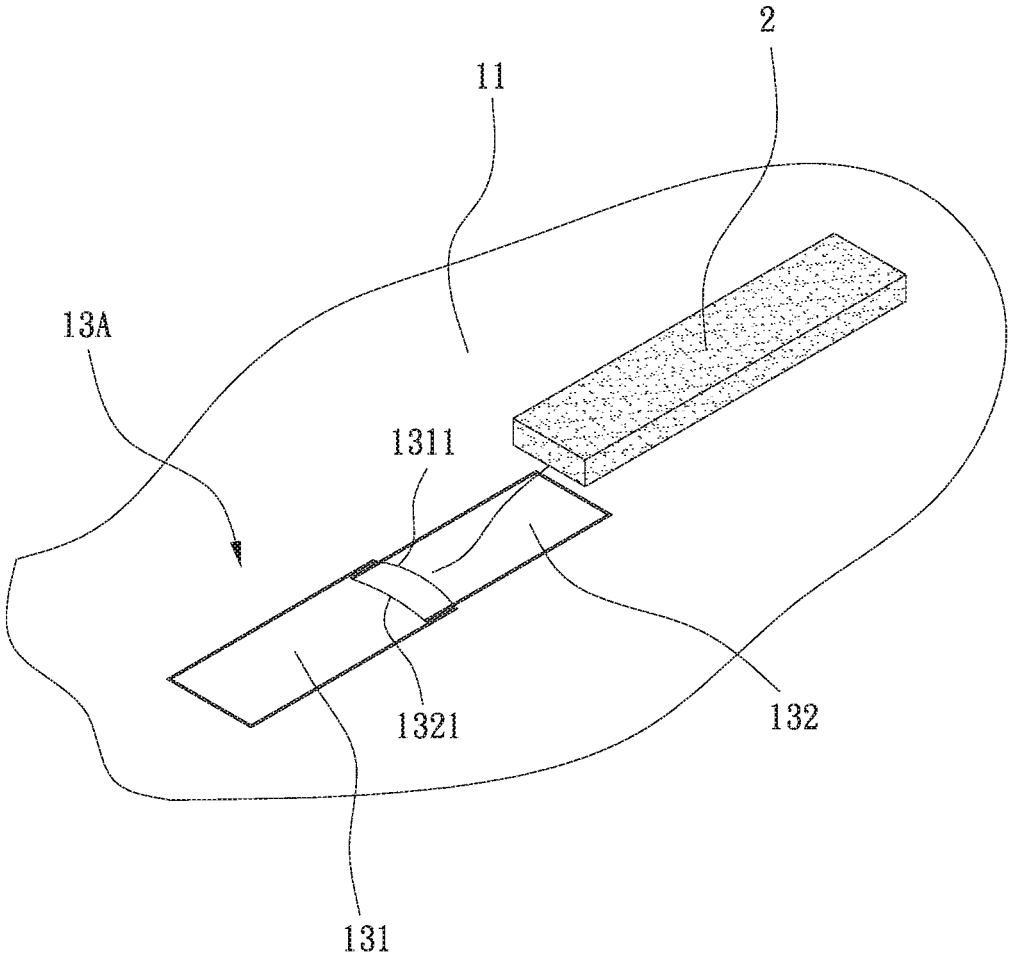
FIG. 4 shows an interlayer pocket disposed on a head portion of a covering body and the assembly relationship of the interlayer pocket and a cushiony pad according to the present invention.

Referring to FIG. 4, which shows one of the interlayer pockets 13A disposed on the crown portion 11 of the covering body according to the present invention, wherein the interlayer pocket 13A has a long and narrow rectangular shape, the length direction of which extends from the front to the rear of the crown portion 11. Moreover, the interlayer pocket 13A is provided with a rectangular shaped upper layer material 131 and a rectangular shaped lower layer material 132. The two long sides and one short side of the lower layer material 132 are fixed to the external surface of the covering body, thereby enabling the other short side of the lower layer material 132 to form a lower opening 1321. The two long sides and one short side of the upper layer material 131 are fixed to the external surface of the covering body, thereby enabling the other short side of the upper layer material 131 to form an upper opening 1311. A portion at one end of the upper opening 1311 of the upper layer material 131 correspondingly overlaps with a portion at one end of the lower opening 1321 of the lower layer material 132, thus positioning the upper opening 1311 on the upper side of the lower layer material 132 and positioning the lower opening 1321 on the lower side of the upper layer material 131. Accordingly, a cushiony pad 2 is disposed inside the interlayer pocket 13A formed by the upper layer material 131 and the lower layer material 132 through the upper opening 1311 of the upper layer material 131, with overlapping of the upper opening 1311 and the lower opening 1321 preventing the cushiony pad 2 from separating from the interlayer pocket 13A.

More explicitly, the upper layer material 131 and the lower layer material 132 can be woven or nonwoven cloth, and machine stitching or a hot melt stitching method is used to fix the three sides thereof to the external surface of the covering body.

Each of the cushiony pads 2 can be made from a piece of foam material, such as sponge or foam. The cushiony pads 2 can be provided with a variety of thickness specifications, thus enabling the user to choose the cushiony pads 2 of suitable thickness to dispose inside the interlayer pockets 13A according to their actual requirements, and use the cushiony pads 2 cushioned between their head and a safety helmet to achieve the object of comfortable wearing thereof.

Figure 5:
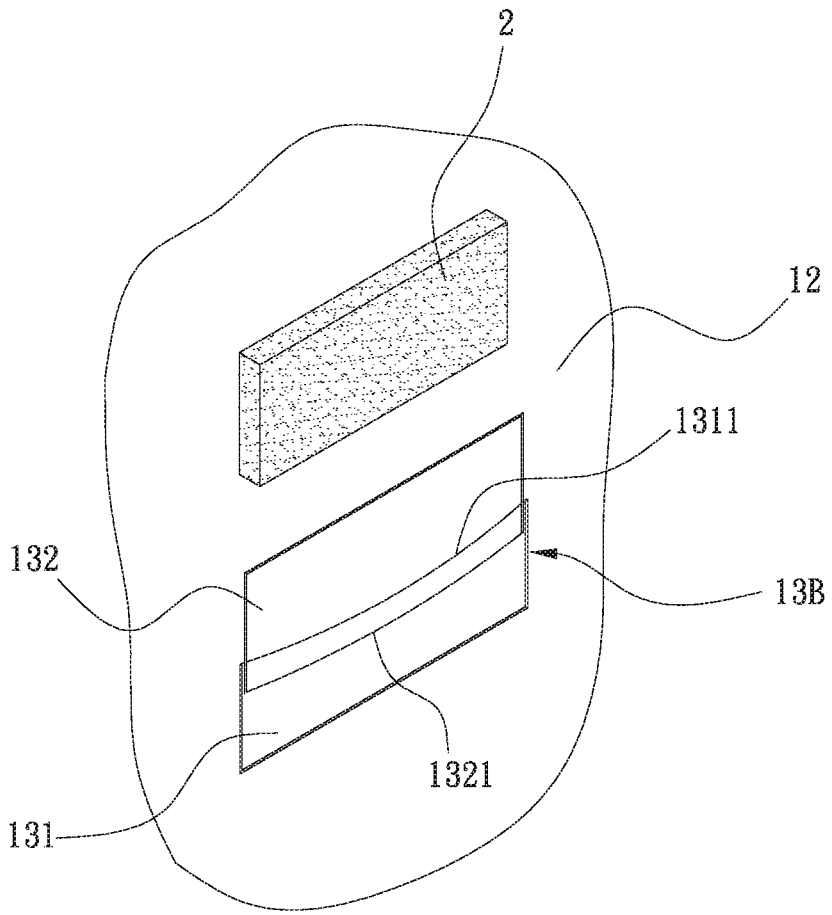
FIG. 5 shows the interlayer pocket disposed on a hindbrain portion of the covering body and the assembly relationship of the interlayer pocket and the cushiony pad according to the present invention.

Referring to FIG. 5, which shows one of the interlayer pockets 13B disposed on the hindbrain portion 12 of the covering body according to the present invention, wherein the interlayer pocket 13B has a rectangular shape of relatively large area, the length direction of which extends from the left side to the right side of the hindbrain portion 12. The interlayer pocket 13B disposed on the hindbrain portion 12 is provided with the same structure as the interlayer pocket 13A disposed on the crown portion 11, with only the dimensional proportions being different. In other words, the interlayer pocket 13B is also provided with the rectangular shaped upper layer material 131 and the rectangular shaped lower layer material 132. The two short sides and one long side of the lower layer material 132 are fixed to the external surface of the covering body, thereby enabling the other long side of the lower layer material 132 to form the lower opening 1321, and the two short sides and one long side of the upper layer material 131 are fixed to the external surface of the covering body, thereby enabling the other long side of the upper layer material 131 to form the upper opening 1311. A portion at one end of the upper opening 1311 of the upper layer material 131 correspondingly overlaps with a portion at one end of the lower opening 1321 of the lower layer material 132, thus positioning the upper opening 1311 on the upper side of the lower layer material 132 and positioning the lower opening 1321 on the lower side of the upper layer material 131. Accordingly, the cushiony pad 2 is disposed inside the interlayer pocket 13B formed by the upper layer material 131 and the lower layer material 132 through the upper opening 1311 of the upper layer material 131, with overlapping of the upper opening 1311 and the lower opening 1321 preventing the cushiony pad 2 from separating from the interlayer pocket 13B.

Figure 6:
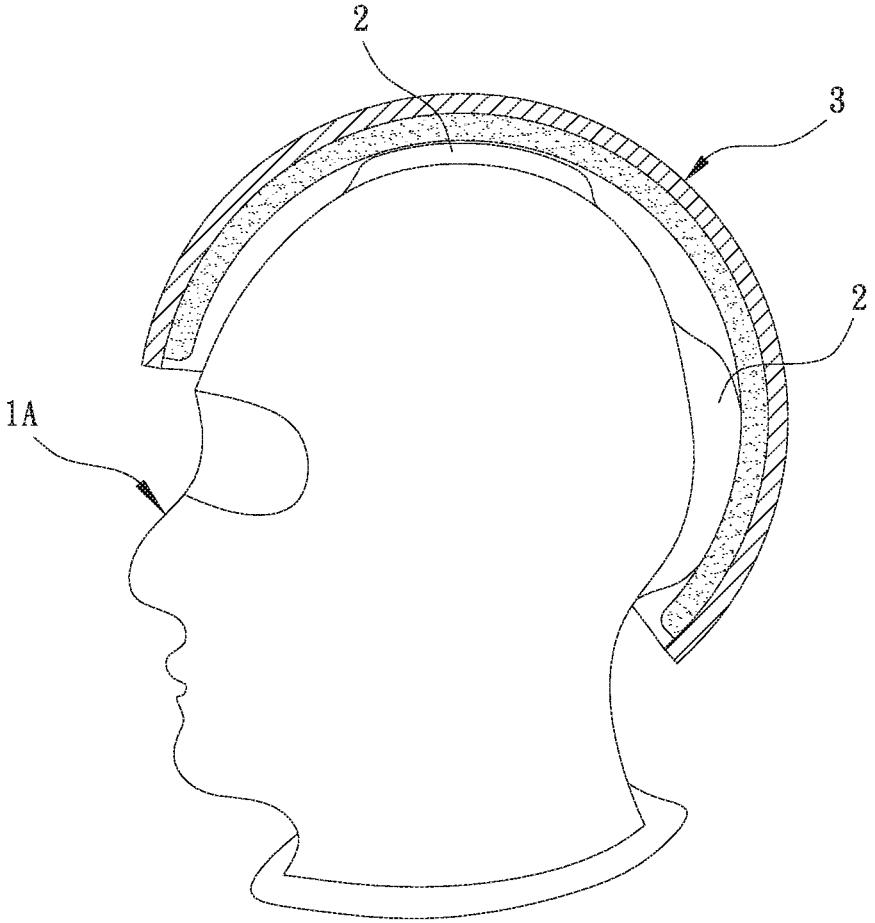
FIG. 6 is a cross-sectional schematic view depicting the state of the support between the head portion and the safety helmet provided by cushiony pads after a user puts on the inner lining and a safety helmet.

Referring to FIG. 6, which shows the interlayer pocket 13A (as shown in FIG. 1) disposed on the crown portion 11 of the covering body according to the present invention and the interlayer pocket 13B disposed on the hindbrain portion 12, wherein, after inserting the cushiony pads 2, an optimum support effect is achieved between the top side and rear of the user's head and a safety helmet 3. Moreover, the user can conveniently replace the cushiony pads 2 with those of different dimensions, as well as enabling choosing and replacing the cushiony pads 2 with different density foam material according to their individual head shape and dimensions to achieve a more suitably perfect fit.

Embodiment 2

Figure 2:
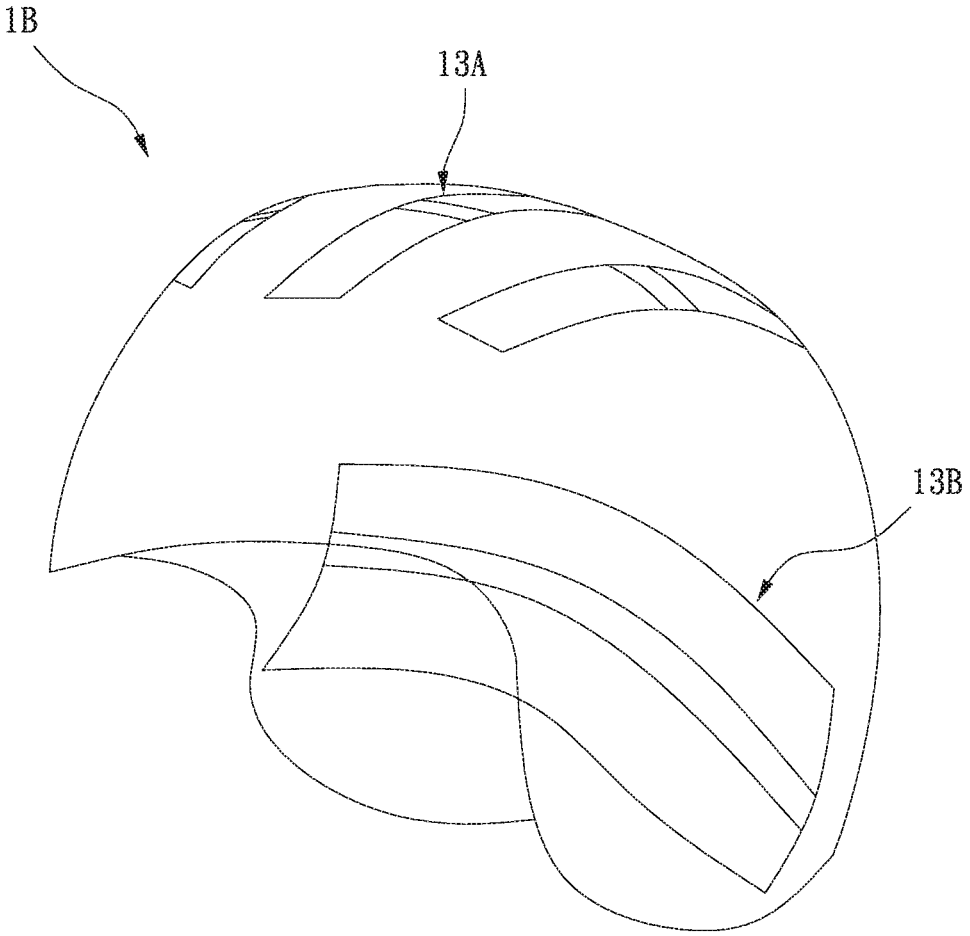
FIG. 2 is a three-dimensional schematic view of an embodiment of a half open face inner lining structure of the present invention.
Figure 8:
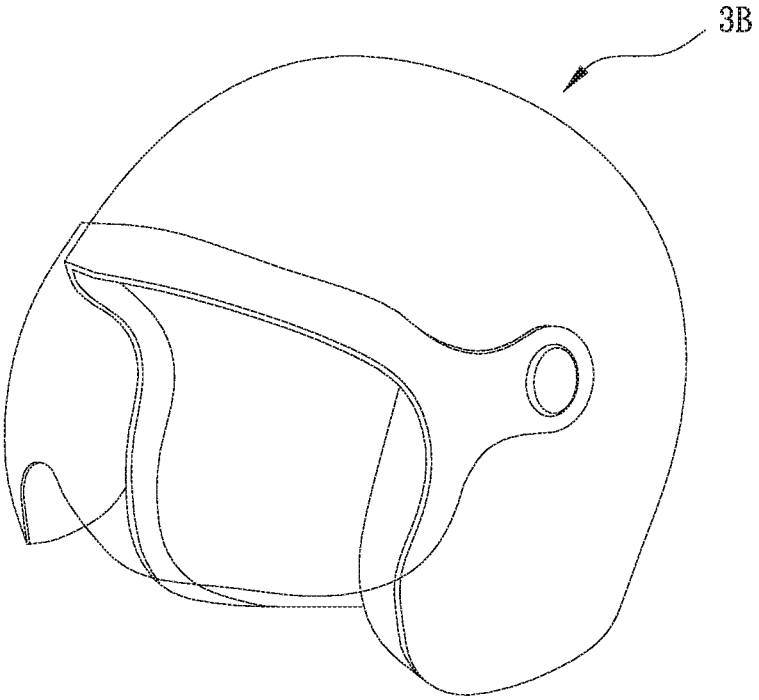
FIG. 8 is a schematic view of a general half open face safety helmet.

FIG. 2 shows a three-dimensional schematic view of a structure of an embodiment of a half open face inner lining 1B of the present invention, wherein the half open face inner lining 1B is provided with a covering body that covers approximately three quarters of the wearer's head when worn, with the upper portion, two sides, and the rear portion of the user's head being covered, and thus suitable for general motorcycle drivers to fittingly wear, such as a half open face safety helmet 3B shown in FIG. 8. Similar to the above-described embodiment 1, the covering body is provided with an inner side surface that contacts the user's head, and an outer side surface relative to the inner side surface. An upper portion of the outer side surface forms the crown portion that corresponds to the upper extreme of the user's head, and a rear portion of the outer side surface forms the hindbrain portion that is connected to the crown portion and corresponds to the hindbrain of the user's head. In the present invention, at least one of the interlayer pockets 13A and at least one of the interlayer pockets 13B are disposed on the crown portion and the hindbrain portion, respectively, according to actual requirements. For example, the embodiment shown in FIG. 2 shows three of the interlayer pockets 13A disposed on the crown portion and one of the interlayer pockets 13B disposed on the hindbrain portion.

Embodiment 3

Figure 3:
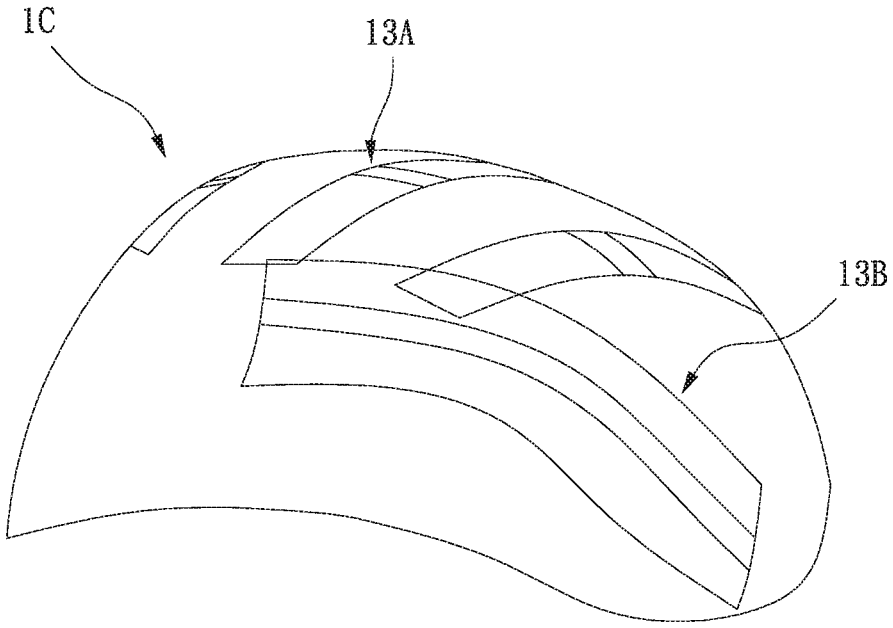
FIG. 3 is a three-dimensional schematic view of an embodiment of an open face inner lining structure of the present invention.
Figure 9:
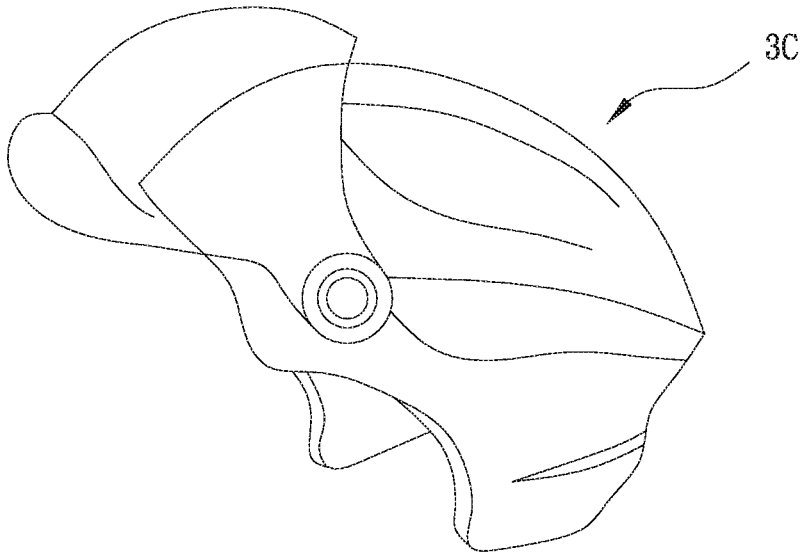
FIG. 9 is a schematic view of a general open face safety helmet.

FIG. 3 shows a three-dimensional schematic view of a structure of an embodiment of an open face inner lining 10 of the present invention, wherein the open face inner lining 10 is provided with a covering body that covers the upper half area of a user's head portion when worn, with both the upper portion and a portion of two sides of the user's head being covered, and thus suitable for general motorcycle riders and construction site workers to fittingly wear, such as an open face safety helmet 3C shown in FIG. 9. Similar to the above-described embodiment 1, the covering body is provided with an inner side surface that contacts the user's head, and an outer side surface relative to the inner side surface. An upper portion of the outer side surface forms a crown portion that corresponds to the upper extreme of the user's head, and a rear portion of the outer side surface forms a hindbrain portion that corresponds to a small area of the hindbrain of the user's head. In the present invention, at least one of the interlayer pockets 13A and at least one of the interlayer pockets 13B are disposed on the crown portion and the hindbrain portion, respectively, according to actual requirements. For example, the embodiment shown in FIG. 3 shows three of the interlayer pockets 13A disposed on the crown portion and one of the interlayer pockets 13B disposed on the hindbrain portion. The structures of the interlayer pockets 13A and 13B are identical to those described above in embodiment 1 and therefore not further detailed herein.

Apart from being disposed on the outer side surface of the covering body, the above-described interlayer pockets 13A and 13B can also be disposed on the inner side surface of the covering body. Accordingly, when the above-described interlayer pockets 13A and 13B are disposed on the inner side surface of the covering body, an interspace is formed between the user's head and the covering body when put onto the head, thereby providing a superior ventilation effect.

According to the safety helmet inner lining provided by the present invention, the cushiony pads of suitable thickness can be chosen to adjust suitability depending on the user's head shape and dimensions for a perfect fit when wearing a safety helmet. Hence, the inner lining and the cushiony pads are used to form an interspace between the user's head and the safety helmet and produce a perfectly fitting outcome, thereby improving comfortability and safety when wearing a safety helmet.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A safety helmet inner lining adjustable for suitable wearing, comprising:

a covering body, which is provided with an inner side surface that contacts a user's head and an outer side surface relative to the inner side surface;

at least one interlayer pocket, which is disposed on the outer side surface or the inner side surface of the covering body; and at least one cushiony pad, which is suitable for placement inside the interlayer pocket, wherein the covering body is formed with a crown portion, and the interlayer pockets are disposed on the crown portion, wherein the interlayer pockets are rectangular shaped, and wherein the interlayer pockets are respectively provided with a rectangular shaped upper layer material and a rectangular shaped lower layer material; the two long sides and one short side of the lower layer material are fixed to an external surface of the covering body, thereby enabling the other short side of the lower layer material to form a lower opening; the two long sides and one short side of the upper layer material are fixed to the external surface of the covering body, thereby enabling the other short side of the upper layer material to form an upper opening; a portion at one end of the upper opening of the upper layer material correspondingly overlaps with a portion at one end of the lower opening of the lower layer material, thus positioning the upper opening on the upper side of the lower layer material and positioning the lower opening on the lower side of the upper layer material.

2. The safety helmet inner lining adjustable for suitable wearing according to claim 1, wherein the covering body is further formed with a hindbrain portion connected to the crown portion, and other interlayer pockets are disposed on the hindbrain portion.

3. The safety helmet inner lining adjustable for suitable wearing according to claim 2, wherein the interlayer pockets are rectangular shaped.

4. The safety helmet inner lining adjustable for suitable wearing according to claim 3, wherein the interlayer pockets are respectively provided with a rectangular shaped upper layer material and a rectangular shaped lower layer material; the two long sides and one short side of the lower layer material are fixed to an external surface of the covering body, thereby enabling the other short side of the lower layer material to form a lower opening; the two long sides and one short side of the upper layer material are fixed to the external surface of the covering body, thereby enabling the other short side of the upper layer material to form an upper opening; a portion at one end of the upper opening of the upper layer material correspondingly overlaps with a portion at one end of the lower opening of the lower layer material, thus positioning the upper opening on the upper side of the lower layer material and positioning the lower opening on the lower side of the upper layer material.

5. The safety helmet inner lining adjustable for suitable wearing according to claim 1, wherein the length direction of the interlayer pockets positioned on the crown portion extend from a front to a rear of the crown portion.

6. The safety helmet inner lining adjustable for suitable wearing according to claim 4, wherein the length direction of the interlayer pockets positioned on the crown portion extend from a front to a rear of the crown portion.

7. The safety helmet inner lining adjustable for suitable wearing according to claim 1, wherein the length direction of the interlayer pockets positioned on the hindbrain portion extend from a left side to the right side of the hindbrain portion.

8. The safety helmet inner lining adjustable for suitable wearing according to claim 4, wherein the length direction of the interlayer pockets positioned on the hindbrain portion extend from a left side to the right side of the hindbrain portion.

9. The safety helmet inner lining adjustable for suitable wearing according to claim 1, wherein the cushiony pads are made from pieces of foam material.

10. The safety helmet inner lining adjustable for suitable wearing according to claim 9, wherein the foam material is sponge or foam.

* * * * *